US009102881B2

(12) United States Patent
Gajda

(10) Patent No.: US 9,102,881 B2
(45) Date of Patent: Aug. 11, 2015

(54) PROCESS FOR INCREASING AROMATICS PRODUCTION FROM NAPHTHA

(75) Inventor: Gregory J. Gajda, Mount Prospect, IL (US)

(73) Assignee: UOP LLC, Des Plaines, IL (US)

( * ) Notice: Subject to any disclaimer, the term of this patent is extended or adjusted under 35 U.S.C. 154(b) by 825 days.

(21) Appl. No.: 13/416,702

(22) Filed: Mar. 9, 2012

(65) Prior Publication Data

US 2012/0277501 A1 Nov. 1, 2012

Related U.S. Application Data

(60) Provisional application No. 61/480,875, filed on Apr. 29, 2011.

(51) Int. Cl.
*C10G 35/00* (2006.01)
*C10G 59/00* (2006.01)

(52) U.S. Cl.
CPC ..... *C10G 59/00* (2013.01); *C10G 2300/1044* (2013.01); *C10G 2400/02* (2013.01); *C10G 2400/30* (2013.01)

(58) Field of Classification Search
CPC ..... C10G 59/00; C10G 2400/30; C10G 2400/02; C10G 2300/1044
USPC ..... 208/133
See application file for complete search history.

(56) References Cited

U.S. PATENT DOCUMENTS 4,401,554 A * 8/1983 Choi et al. ..... 208/64

OTHER PUBLICATIONS

U.S. Appl. No. 13/416,513, filed Mar. 9, 2012, Serban.
U.S. Appl. No. 13/416,577, filed Mar. 9, 2012, Negiz.
U.S. Appl. No. 13/417,181, filed Mar. 9, 2012, Gajda.
U.S. Appl. No. 13/417,200, filed Mar. 9, 2012, Wegerer.
U.S. Appl. No. 13/417,202, filed Mar. 9, 2012, Gajda.
U.S. Appl. No. 13/417,203, filed Mar. 10, 2012, Gajda.
U.S. Appl. No. 13/440,487, filed Apr. 5, 2012, Moser.
U.S. Appl. No. 13/440,527, filed Apr. 5, 2012, Moser.
U.S. Appl. No. 13/440,381, filed Apr. 5, 2012, Moser.
U.S. Appl. No. 13/428,005 filed Mar. 23, 2012, Serban.
U.S. Appl. No. 13/416,604, filed Mar. 9, 2012, Serban.
U.S. Appl. No. 13/327,164, filed Dec. 15, 2011, Moser.
U.S. Appl. No. 13/327,200, filed Dec. 15, 2011, Moser.
U.S. Appl. No. 13/327,143, filed Dec. 15, 2011, Moser.
U.S. Appl. No. 13/327,212, filed Dec. 15, 2011, Moser.
U.S. Appl. No. 13/327,220, filed Dec. 15, 2011, Moser.
U.S. Appl. No. 13/327,185, filed Dec. 15, 2011, Serban.
U.S. Appl. No. 13/327,178, filed Dec. 15, 2011, Serban.
U.S. Appl. No. 13/327,170, filed Dec. 15, 2011, Serban.
U.S. Appl. No. 13/327,192, filed Dec. 15, 2011, Serban.

* cited by examiner

*Primary Examiner* — Randy Boyer
*Assistant Examiner* — Juan Valencia

(57) ABSTRACT

A process for reforming a hydrocarbon stream is presented. The process involves splitting a naphtha feedstream to at least two feedstreams and passing each feedstream to separation reformers. The reformers are operated under different conditions to utilize the differences in the reaction properties of the different hydrocarbon components. The process further includes passing one or more catalyst streams through the reformers to optimize selectivity and conversions.

20 Claims, 4 Drawing Sheets

PROCESS FOR INCREASING AROMATICS PRODUCTION FROM NAPHTHA

CROSS-REFERENCE TO RELATED APPLICATION

This application claims priority from U.S. Provisional Application No. 61/480,875, filed Apr. 29, 2011, the contents of which are hereby incorporated by reference in its entirety.

FIELD OF THE INVENTION

The present invention relates to the process of enhancing the production of aromatic compounds. In particular the improvement and enhancement of aromatic compounds such as benzene, toluene and xylenes from a naphtha feedstream.

BACKGROUND OF THE INVENTION

The reforming of petroleum raw materials is an important process for producing useful products. One important process is the separation and upgrading of hydrocarbons for a motor fuel, such as producing a naphtha feedstream and upgrading the octane value of the naphtha in the production of gasoline. However, hydrocarbon feedstreams from a raw petroleum source include the production of useful chemical precursors for use in the production of plastics, detergents and other products.

The upgrading of gasoline is an important process, and improvements for the conversion of naphtha feedstreams to increase the octane number have been presented in U.S. Pat. Nos. 3,729,409, 3,753,891, 3,767,568, 4,839,024, 4,882,040 and 5,242,576. These processes involve a variety of means to enhance octane number, and particularly for enhancing the aromatic content of gasoline.

The enhancement of the yields of aromatics from a naphtha feedstream can be used to increase the recovery of aromatic compounds, and in particular benzene and toluene, for use in other high value products, such as plastics.

SUMMARY OF THE INVENTION

The improvement in yields of aromatics from a naphtha feedstream is presented. The process includes splitting a naphtha feedstream in a fractionation unit to generate several streams to be passed to different reformers. The fractionation unit generates a first stream comprising light hydrocarbons, a second stream comprising intermediate range hydrocarbons, and a third stream comprising heavy hydrocarbons. The first stream is passed to a first reformer, that is operated at a first set of reaction conditions, and generates a first effluent stream. The second stream is passed to a second reformer that is operated at a second set of reaction conditions, and generates a second effluent stream. And the third stream is passed to a third reformer that is operated at a third set of reaction conditions, and generates a third effluent stream.

The first reformer effluent stream and the second reformer effluent stream are passed to a fourth reformer, that is operated at a fourth set of reaction conditions and generates a fourth effluent stream. The third reformer effluent stream and the fourth reformer effluent stream are passed to a fifth reformer, that is operated at a fifth set of reaction conditions and generates a fifth reformer effluent stream. The fifth reformer effluent stream is passed to an aromatics extraction unit and generates a purified aromatics stream.

In addition, the process includes passing catalyst through the different reformers, where each reformer has an inlet and an outlet for a catalyst stream. In one embodiment, a first catalyst stream, comprising fresh or regenerated catalyst, is passed to the first reformer, and creates a first reformer catalyst effluent stream. The reformer catalyst effluent stream is passed to the fourth reformer, and creates a fourth reformer catalyst effluent stream. The fourth reformer catalyst effluent stream is passed to the fifth reformer, and creates a fifth reformer catalyst effluent stream. A second catalyst stream, comprising fresh or regenerated catalyst, is passed to the second reformer, and creates a second reformer catalyst effluent stream. The second reformer catalyst effluent stream is passed to the third reformer, and creates a third reformer catalyst effluent stream. The third reformer catalyst effluent stream and the fifth reformer catalyst effluent stream are passed to at least one regenerator.

The process of passing the catalyst and the hydrocarbon process streams through the different reformers allows for contacting the light hydrocarbon streams with the freshest catalyst and improves selectivity and conversion.

Other objects, advantages and applications of the present invention will become apparent to those skilled in the art from the following detailed description and drawings.

DETAILED DESCRIPTION OF THE INVENTION

Figure 1:
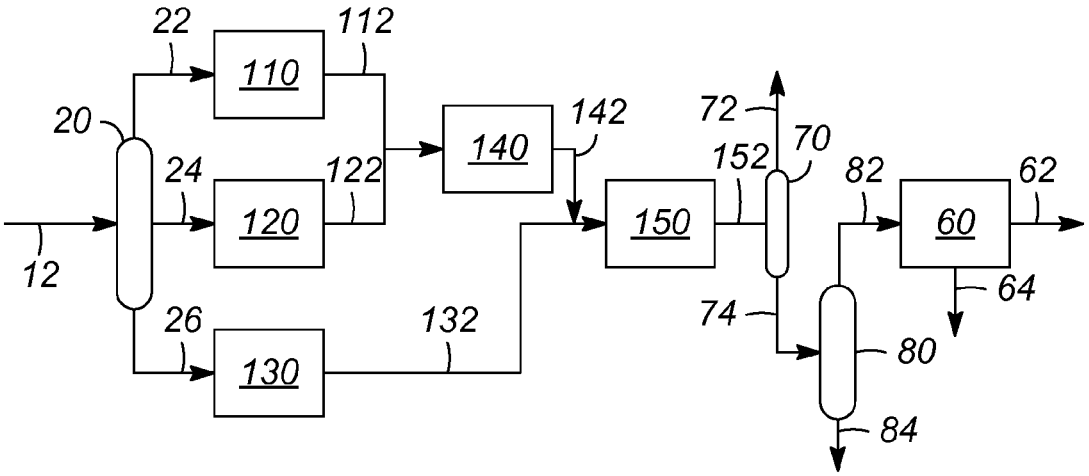
FIG. 1 is one embodiment of the invention showing a first split feed process for the flow of the hydrocarbon streams.

The present invention is directed to improving the yields of aromatics from a hydrocarbon feedstream. In particular, the improvement is for a naphtha feedstream where the hydrocarbons are reformed to increase the yields of aromatics in the C6 to C8 range. The new process is designed to utilize a single catalyst, rather than a more expensive process that includes multiple catalysts.

In hydrocarbon processing, reforming is used to improve the quality of a hydrocarbon feedstock, and in particular a naphtha feedstock. The feedstock comprises many compounds and the reforming process proceeds along numerous pathways. The reaction rates vary with temperature, and the Arrhenius equation captures the relationship between the reaction rate and temperature. The reaction rate is controlled by the activation energy for a particular reaction, and with the many reactions in the reforming process, there are many, dissimilar activation energies for the different reactions. For the different reactions, it is possible to manipulate the conversion of one hydrocarbon to a desired product, e.g. hexane to benzene. While using the same catalyst, the reactions can be manipulated through changing the temperature under which the reactions are carried out. This manipulation is further enhanced by, at least, a partial separation of the components within the naphtha mixture into separate feeds. The different feeds can then be processed to enhance selectivity control to the desired product, or in this case to the production of aromatics in the C6 to C8 range.

The reforming process is substantially endothermic, and as such a substantial amount of heat is added to maintain the temperature of reaction. Different components within the naphtha mixture have a greater endothermicity during the dehydrogenation process. The present invention is aimed at separating the process into at least two reaction zones, where one zone is substantially isothermal, and another zone is operated with a non-isothermal temperature profile. The non-isothermal zone includes a feed stream that is made up of hydrocarbon components that are converted to a product through highly endothermic catalytic reforming reactions, and which result in a significant temperature decrease in the reaction zone. Examples include naphthenic compounds converted to aromatics. The isothermal reaction zone includes a feed that while the components can have different activation energies, the reactions are relatively low endothermic catalytic reforming reactions, and are favored at high temperatures. The process can include passing the effluent stream from the non-isothermal zone to the isothermal zone, as the components having high endothermicity will have predominantly reacted in the non-isothermal zone.

One aspect of the present invention was the discovery that the designs go against the belief of longer processing times with hydrocarbon components that are the most difficult to reform. In particular, it is more difficult to reform C6s to aromatics than to reform C7s and higher components. Therefore, one would suspect that the C6 compounds should have a greater contact time with the catalyst than C7 and higher components. Studies have found the reverse to be true. The C6 compounds need a relatively short contact time. This is counter intuitive, and the process turns the general idea upside down when processing separate components. This leads to several features for various designs, including separating and processing at higher temperatures.

One consideration when processing hydrocarbons in a reformer, is the balancing of reaction conditions. In a reformer there are competing reactions. The reactions take place at different rates due to differing activation energies and other factors. It has been found that increasing the temperature for some of the reforming reactions with lighter hydrocarbons favors the dehydrogenation and cyclization of hydrocarbons over other less favorable reactions, such as catalytic cracking. However, the temperature must also be low enough to prevent thermal cracking from occurring to any significant extent. Control to limit the cracking of hydrocarbon constituents can also be performed using different catalysts, such as low acid, or non-acidic, catalysts.

For purposes of the description of the reactions, there are several reactions that occur in a reformer. The principal ones include dehydrogenation and cyclization, and as used hereinafter, the use of the term dehydrogenation is intended to include cyclization.

One embodiment of this invention is a process for producing aromatics from a hydrocarbon feedstream and is shown in FIG. 1. The process includes the separation of the hydrocarbon feedstream into several process streams and processing each process stream under different conditions. The feedstream 12 is passed to a separation unit 20 to produce a first hydrocarbon stream 22 comprising C6 and lighter hydrocarbons, a second hydrocarbon stream 24 comprising C7 hydrocarbons, and a third hydrocarbon stream 26 comprising C8 and heavier hydrocarbons. The first hydrocarbon stream 22 is passed to a first reformer 110 to generate a first effluent stream 112. The second hydrocarbon stream 24 is passed to a second reformer 120 to generate a second effluent stream 122. The third hydrocarbon stream 26 is passed to a third reformer 130 to generate a third effluent stream 132. The first reformer effluent stream 112 and the second reformer effluent stream 122 are passed to a fourth reformer 140 to generate a fourth effluent stream 142. The third reformer effluent stream 132 and the fourth reformer effluent stream 142 are passed to a fifth reformer 150 to generate a fifth effluent stream 152. The fifth effluent stream is passed to an aromatics extraction unit 60 to create a purified aromatics stream 62 and a raffinate stream 64.

The aromatics extraction unit 60 can comprise different methods of separating aromatics from a hydrocarbon stream. One industry standard is the Sulfolane™ process, which is an extractive distillation process utilizing sulfolane to facilitate high purity extraction of aromatics. The Sulfolane™ process is well known to those skilled in the art.

The different reformers are operated at different reaction and operating conditions. The different conditions will generally include different operating, or inlet, temperatures to the reformers.

The process is to recover aromatics, and the aromatics extraction unit 60 can operate more efficiently with the removal of light gases and heavier hydrocarbon components. The process can include passing the fifth reformer effluent stream 152 to a light hydrocarbon fractionation unit 70. The light hydrocarbon fractionation unit 70 generates an overhead stream 72 comprising light gases, such as hydrogen, methane, and C4 or C5 and lighter hydrocarbons. The fractionation unit 70 also generates a bottoms stream 74. The bottoms stream 74 is passed to a reformate splitter 80, where the reformate splitter 80 generates a reformate overhead stream 82 and a reformate bottoms stream 84. The reformate overhead stream 82 comprises lighter hydrocarbons in the C6 to C8 range, and in particular aromatics in the C6 to C7 range. The reformate bottoms stream 84 comprises heavier hydrocarbons, including aromatics in the C8+ range. The reformate overhead stream 82 is passed to the aromatics extraction unit 60, for the recovery of a purified aromatics stream.

Figure 2:
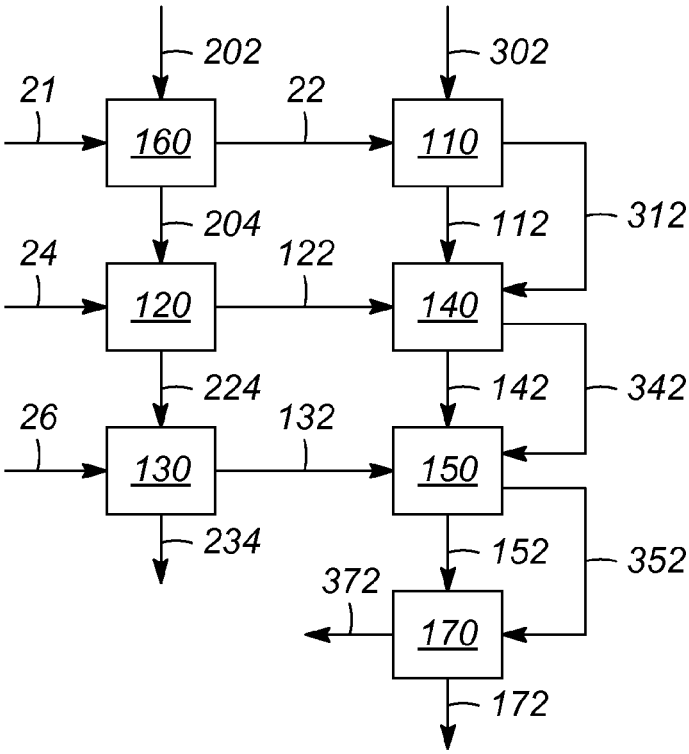
FIG. 2 is an embodiment of the invention showing a split feed process with the catalyst flows through the reformers.

The invention is a process that allows for different catalyst flows, as well as different catalysts, while the hydrocarbon process streams are as described in FIG. 1. In one embodiment, the process for the catalyst flows is shown in FIG. 2, and is diagramed to shown the flow of catalyst in addition to the process stream flows. The process streams flow as described above. A first catalyst stream 302 flows to the first reformer 110 to generate a first reformer catalyst effluent stream 312. The first reformer effluent stream 312 flows to the fourth reformer 140 to generate a fourth reformer catalyst effluent stream 342. The fourth reformer catalyst effluent stream 342 is passed to the fifth reformer 150 to generate a fifth reformer catalyst effluent stream 352. The fifth reformer catalyst effluent stream 352 is passed to a regenerator (not shown).

In a parallel process, with the passing of the first catalyst stream a second catalyst stream 204 flows to the second reformer 120 to generate a second reformer catalyst effluent stream 224. The second reformer catalyst effluent stream 224 flows to the third reformer 130 to generate a third reformer catalyst effluent stream 234, and the third reformer catalyst effluent stream 234 is passed to the regenerator (not shown). When the first catalyst stream and the second catalyst stream comprise different catalysts, they will be passed to separate regenerators, or to a regenerator that has been swept to remove one type of catalyst before passing the second type of catalyst to the regenerator.

The process can further include adding a sixth reformer 160 where the first process stream 21 is passed to the sixth reformer 160 to generate a sixth reformer effluent stream 22. The sixth reformer effluent stream 22 is then passed to the first reformer 110. With the sixth reformer 160, the second catalyst stream 202 is passed to the sixth reformer 160 to generate the sixth reformer catalyst effluent stream 204, which is then passed to the second reformer 120. This process allows for the first process stream 21 to be partially dehydrogenated prior to the passage of the first process stream to the first reformer 110, where process conditions are different, and the catalyst can be different.

The process can include a plurality of reformers with heaters disposed between reformers. One such embodiment includes a plurality of reformers toward the end of the process. A seventh reformer 170 can be positioned after the fifth reformer 150, and the fifth reformer process stream 152 is passed to the seventh reformer 170, along with passage of the fifth reformer catalyst effluent stream 352 to the seventh reformer, thereby generating a product stream 172 and a seventh reformer catalyst effluent stream 372. The product stream 172 is passed to the aromatics extraction unit 60, and the seventh reformer catalyst effluent stream 372 is passed to a regenerator.

Figure 3:
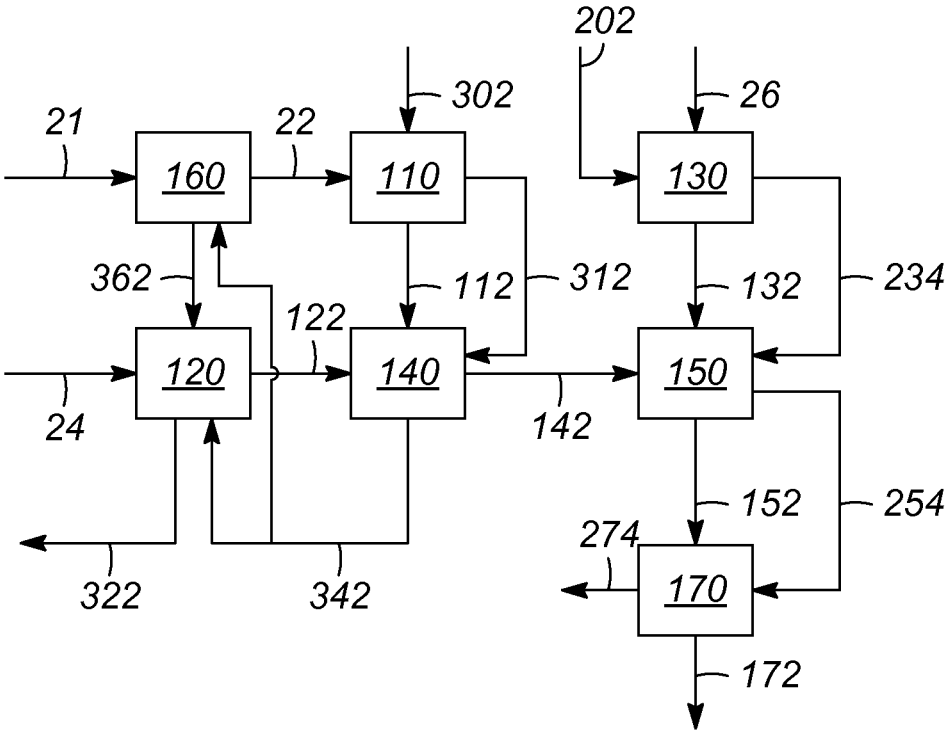
FIG. 3 is another embodiment showing a split feed process with an alternate catalyst flow system.

A second catalyst flow plan is also presented in FIG. 3, wherein the hydrocarbon stream is passed as in FIG. 1. The process includes passing a first catalyst stream 302 to the first reformer 110, thereby generating a first reformer catalyst effluent stream 312 having catalyst with partial coking. The first reformer catalyst effluent stream 312 is passed to the fourth reformer 140 and generates a fourth reformer catalyst effluent stream 342. The fourth reformer catalyst effluent stream 342 is passed to the second reformer 120 and generates a second reformer catalyst effluent stream 322.

The second catalyst flow plan include passing a second catalyst stream 202 to the third reformer 130 which generates a third reformer catalyst effluent stream 234, which has partial coking. The third reformer catalyst effluent stream 234 is passed to the fifth reformer 150, which generates a fifth reformer catalyst effluent stream 254. The second reformer catalyst effluent stream 322 and the fifth reformer catalyst effluent stream 254 can be passed to a regenerator. When the first catalyst stream 302 and the second catalyst stream 202 comprise different catalysts, the respective catalyst streams are passed to different regenerators, or to the same regenerator, but at different times with the regenerator purged of one catalyst before loading the second catalyst.

Optionally the process can further include the use of a sixth reformer 160. The first hydrocarbon process stream 21 is passed to the sixth reformer 160 to generate an intermediate process stream 22 that is passed to the first reformer 110. The first process stream 21 is the light overhead stream separated in the separation unit 20. The fourth catalyst effluent stream 342 is passed to the sixth reformer 160 prior to passing the fourth catalyst effluent stream 342 to the second reformer 120. The sixth reformer 160 generates a sixth reformer catalyst effluent stream 362 which is passed to the second reformer 120.

Figure 4:
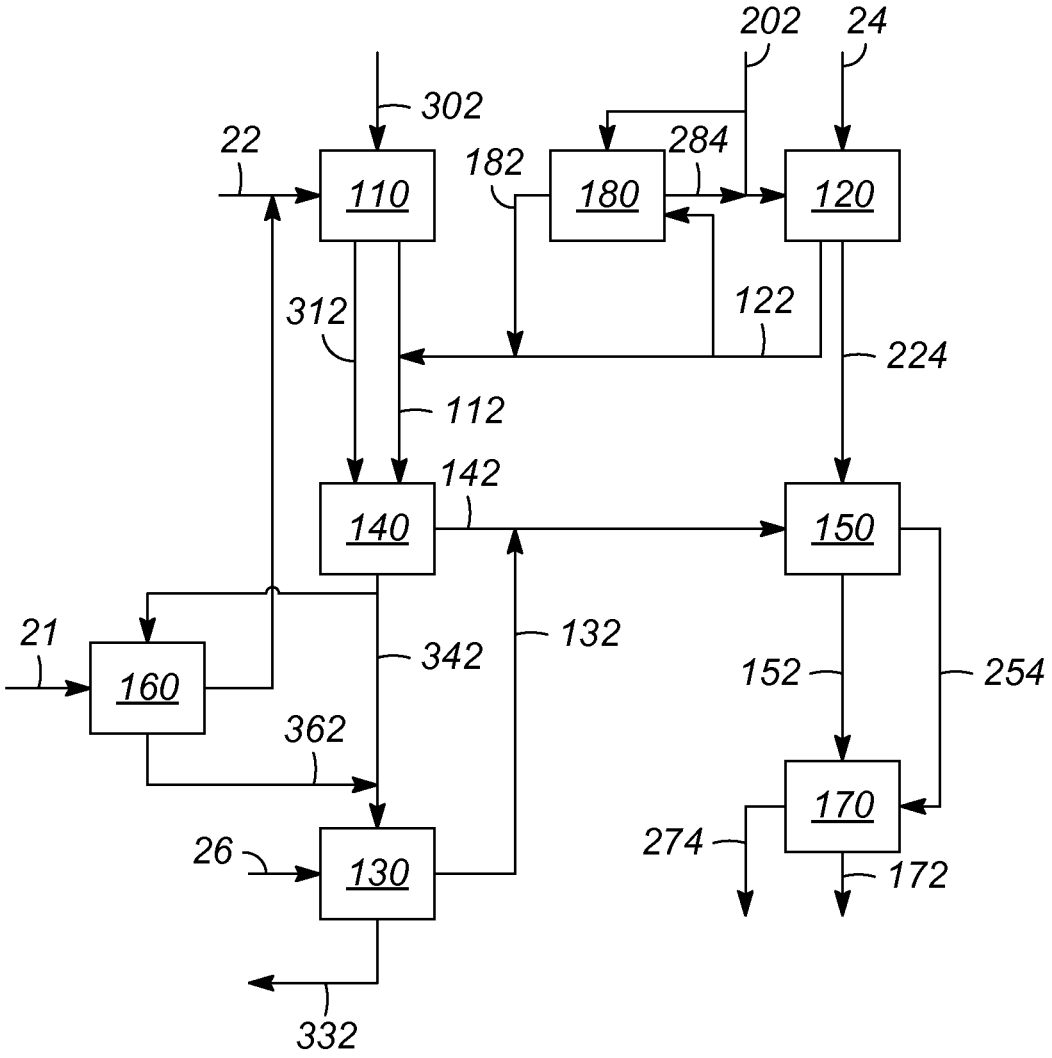
FIG. 4 is an embodiment showing a process with a split naphtha feed with an alternate catalyst flow system.

In a third catalyst flow plan, as presented in FIG. 4, the main flow of the hydrocarbon process stream is still following the pattern as shown in FIG. 1. The process includes passing a first catalyst stream 302 to the first reformer 110, to create a first reformer catalyst effluent stream 312. The first reformer catalyst effluent stream 312 is passed to the fourth reformer 140 where a fourth reformer catalyst effluent stream 342 is generated. The fourth reformer catalyst effluent stream 342 is passed to the third reformer 130 where a third reformer catalyst effluent stream 332 is generated, and passed back to the regenerator.

The process includes a second catalyst stream 202 which is passed to the second reformer 120 and generates a second reformer catalyst effluent stream 224. The second reformer catalyst effluent stream 224 is passed to the fifth reformer 150 and generates a fifth reformer catalyst effluent stream 254. The fifth reformer catalyst effluent stream 254 is passed to the regenerator. When the first and second catalyst stream comprise different catalysts, they can be regenerated in separate regenerators, or the regenerator can be purged on one catalyst before regenerating the other catalyst.

In one option, the process can include passing the first stream 21 to a sixth reformer 160, to generate a sixth reformer effluent stream 22, and passing the sixth reformer effluent stream 22 to the first reformer 110. The catalyst in this option follows a different path. The fourth catalyst effluent stream 342 is passed to the sixth reformer 160 and creates a sixth reformer catalyst effluent stream 362. The sixth reformer catalyst effluent stream 362 is passed to the third reformer 130. The third reformer 130 generates a third reformer catalyst effluent stream 332 that is passed to the regenerator.

In a second option, the process can include a seventh reformer 170. The fifth reformer effluent stream 152 is passed to the seventh reformer 170, and the fifth reformer catalyst effluent stream 254 is passed to the seventh reformer 170. The seventh reformer 170 generates a product stream 172 that is passed to the aromatics extraction unit 60, and a seventh reformer catalyst effluent stream 274 is created and passed to the regenerator.

In a third option for this embodiment, the process can include an eighth reformer 180. The second reformer process stream 122 is passed to the eighth reformer 180 and generates an eighth reformer effluent stream 182, which is passed to the fourth reformer 140. The second catalyst stream 202, coming from the regenerator, is passed to the eighth reformer 180 and creates an eighth reformer catalyst effluent stream 284. The eighth reformer catalyst effluent stream 284 is passed to the second reformer 120. This creates a partial counter current operation with respect to the catalyst flow and the process stream flow, for the second 120 and eighth reformers 180.

Figure 5:
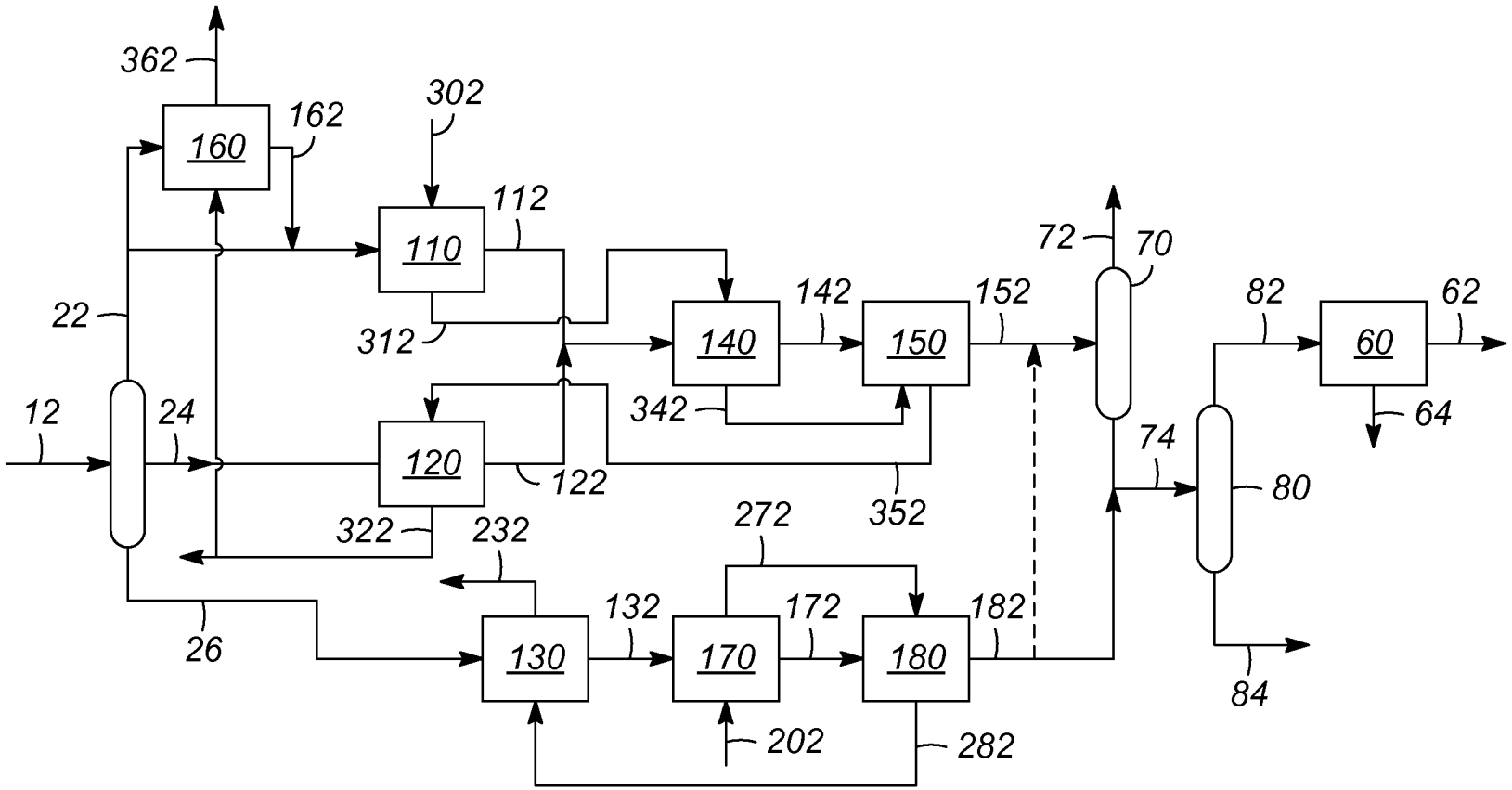
FIG. 5 is a split feed process with segregation of the reformers and separate catalyst flow system.

An additional flow of the catalyst is present in FIG. 5. In this flow scheme, the cross over of the hydrocarbon process streams is limited to the light stream and the intermediate stream. A naphtha feedstream 12 is passed to a fractionation unit 20 to generate a first stream 22, comprising light hydrocarbons, a second stream 24, comprising intermediate hydrocarbons, and a third stream 26 comprising heavier hydrocarbons. The first stream 22 is passed to a first reformer 110, and generates a first reformer effluent 112. The second stream 24 is passed to a second reformer 120 and generates a second reformer effluent stream 122. The first reformer effluent stream 112 and the second reformer effluent stream 122 are passed to a fourth reformer 140 to generate a fourth reformer effluent stream 142. The fourth reformer effluent stream 142 is passed to a fifth reformer 150 and generates a fifth reformer effluent stream 152. The fifth reformer effluent stream 152 is passed to an aromatics extraction unit 60 to generate a purified aromatics stream 62. The third stream 26 is passed to a third reformer 130 to generate a third reformer effluent stream 132. The third reformer effluent stream 132 is passed to the aromatics extraction unit 60 to generate the purified aromatics stream 62 and a raffinate stream 64 having a reduced aromatics content.

The different reformers can be operated at different reaction conditions, including different temperatures, pressures, WHSVs, and different catalysts. In particular, one option calls for the first stream 22 and the second stream 24 to be passed through reformers using a first catalyst stream 302, and the third stream 26 will pass through reformers using a second catalyst stream 202, wherein the first catalyst stream 302 and second catalyst stream 202 comprise different catalysts.

In this embodiment, the process can further include passing the first catalyst stream 302 to the first reformer 110, thereby generating a first catalyst effluent stream 312. The first catalyst effluent stream 312 is passed to the fourth reformer 140 and creates a fourth catalyst effluent stream 342. The fourth catalyst effluent stream 342 is passed to the fifth reformer 150 and creates a fifth catalyst effluent stream 352. The fifth reformer catalyst effluent stream 352 is passed back to the second reformer 120 and generates a second reformer catalyst effluent stream 322. The second reformer catalyst effluent stream 322 is passed to a regenerator to regenerate the catalyst.

The process can include passing the second reformer catalyst effluent stream 322 to the catalyst regenerator to regenerate the catalyst, and sending the regenerated catalyst to the first reformer 110 as the first catalyst stream 302. The process can also include a sixth reformer 160, where the first stream 22 is passed to the sixth reformer 160 prior to passing the first stream 22 to the first reformer 110. The sixth reformer 160 generates a sixth reformer effluent stream 162 which is passed to the first reformer 110. With the sixth reformer 160, the second reformer catalyst effluent stream 322 is passed to the sixth reformer 160 and generates a sixth reformer catalyst effluent stream 362. The sixth reformer catalyst effluent stream 362 is passed to the catalyst regenerator to generate the first catalyst stream 302.

The process can include additional reformers for the second catalyst stream 202 and can include a seventh reformer 170 and an eighth reformer 180. The third reformer effluent stream 132 is passed to the seventh reformer 170 to generate a seventh reformer effluent stream 172. The seventh reformer effluent stream 172 can be passed to the aromatics extraction unit 60, or passed to an eighth reformer 180, to generate an eighth reformer effluent stream 182, which is passed to the aromatics extraction unit 60.

With the additional reformers, 170, 180, the second catalyst stream 202 is passed to the seventh reformer 170 and generates a seventh reformer catalyst effluent stream 272. The seventh reformer catalyst effluent stream 272 is passed to the eighth reformer 180 and generates an eighth reformer catalyst effluent stream 282. The eighth reformer catalyst effluent stream 282 is passed to the third reformer 130 and generates the third reformer catalyst effluent stream 232. The third reformer catalyst effluent stream 232 is passed to a regenerator to regenerate the second catalyst.

The use of parallel processing of the hydrocarbon streams allows for two catalyst streams comprising different catalysts. When different catalysts are used, the first catalyst stream will be include a catalyst having a low acidity, or will be a non-acidic catalyst for dehydrogenating the naphthenes and to cyclize the lighter hydrocarbons. The low acidic, or non-acidic, catalyst will minimize any cracking reactions, and can operate at a higher temperature.

Data taken from interreactor samples show conversion generally proceeds from heaviest to lightest components, and segregating the lighter hydrocarbon components and reacting them with the freshest catalyst maximizes conversion and selectivity.

The flow schemes are designed to have two parallel reactor stacks. With the first scheme two catalysts are used with each hydrocarbon stream using the first catalyst and the lightest hydrocarbons seeing the freshest catalyst. Each hydrocarbon stream is passed to one or more reformers using the second catalyst for further processing. The second scheme uses only one catalyst and takes advantage of the ease of dehydrogenating cyclohexanes with partially deactivated catalyst to perform stage 1 reactions rather than using a separate low acidity catalyst. Again, the lighter components see the freshest catalyst to maximize aromatics formation efficiency. The third scheme allows for lower pressure, or more severe conditions, with the second stream of catalyst where the hydrocarbon streams flow from lower severity conditions in earlier reformers to higher severity conditions in later reformers, which favors aromatics formation. Due to operation under more severe conditions, the light hydrocarbon stream will generally have a shorter residence time in the reformer. The fourth scheme separates the heavy stream comprising C8+ hydrocarbons and recognizes that the C8+ conversion is relatively easy using conventional catalysts. The C6 and C7 are reacted under more severe conditions to aromatization and cyclization of the hydrocarbon components.

The present invention has found that with split feeds, the operating conditions are different to generate an improvement in yields. For example, in this process, the first operating temperature is greater than the third operating temperature. The first operating temperature is greater than 540° C., and preferably greater than 560° C. The third operating temperature is less than 540° C., and is kept to a value less than the first operating temperature. While the process operates reformers at targeted reaction temperatures, the process is endothermic, and the temperatures in the reactors generally will drop as the reaction proceeds. Therefore, the temperature at the inlet of the reactor is generally the highest temperature, and is the temperature that is controlled. For purposes of this description, the terms 'reaction temperature' can be used interchangeably with 'inlet temperature' and when the term 'reaction temperature' is used, it is intended to mean the temperature at the inlet conditions of the reactor.

The process involves the parallel flow of the hydrocarbon process streams through the reformers. The catalyst can flow in parallel, or in series through the reformers. A parallel process flow of the catalyst includes the splitting of a catalyst stream from the regenerator into a plurality of catalyst feedstreams, and passing one of the catalyst feedstreams to each reformer. A series flow of the catalyst includes the passing of the catalyst from the regenerator to a first reformer, and passing catalyst from the first reformer to the second reformer. The process also allows for the use of several types of catalysts, though it is preferred that only one or two types of catalysts are used in the process. When two catalysts are used, each is passed through a separate regenerator, and the catalysts are directed to different reformers.

As presented herein, the reformer is a reactor that can comprise a plurality of reactor beds, and is intended to incorporate the use of multiple reactor beds within the scope of the invention. The reformer can also include interbed heaters, wherein the process reheats catalyst and/or the process stream as the catalyst and process stream flow from one reactor bed to a sequential reactor bed within the reformer. The process is an endothermic process, and the reformers can comprise multiple reactor beds with interbed heaters. The reactor beds are sized with the interbed heaters to maintain the temperature of the reaction in the reactors. A relatively large reactor bed will experience a significant temperature drop, and can have adverse consequences on the reactions. Likewise, between reformers, such as the first reformer and the third reformer, there can be an inter-reformer heater to heat the process stream to a desired inlet temperature. The catalyst can also pass through inter-reformer heaters to bring the catalyst up to the desired reformer inlet temperatures. The most common type of interbed heater is a fired heater that heats the fluid and catalyst flowing in tubes. Other heat exchangers can be used.

A particular reforming reactor is one that performs a high temperature endothermic catalytic reaction for the cyclization and dehydrogenation of hydrocarbons. This reformer increases the aromatics content of a naphtha feedstream, and generates a hydrogen stream also. In particular, the production of benzene, toluene and xylenes.

The process can further include a light gas separation unit for processing the effluent stream from the reformers. The light gas separation unit is typically a light fractionator for the separation of lighter gases from the effluent streams from the reformers. The first reformer is operated at more severe conditions and generated more light gases. The light gas separation unit can be a debutanizer, or a depentanizer for removing C4 and lighter gases, or C5 and lighter gases respectively. The choice of a debutanizer or depentanizer can depend on the desired content of the effluent stream to be passed to the aromatics separation unit.

The processing conditions of the different reformers allows for different operational control. Additional variables that are controllable include the space velocities, the hydrogen to hydrocarbon feed ratios, and the pressures. It is preferred that the pressure in the reformer with the lighter hydrocarbons is operated at a lower pressure that in the reformer with the heavier hydrocarbons. An example for operating pressures for the first reformer are from 130 kPa to 310 kPa with a preferred pressure of around 170 kPa (10 psig), and operating pressures for the second reformer are from 240 kPa to 580 kPa with a preferred pressure of around 450 kPa (50 psig).

The separation of the feeds to process the different feeds through different reformers produces an increase in the aromatics yields. The passing of an effluent stream from one reformer to another reformer can include passing the effluent stream to an intermediate reactor within the reformers. It is intended that the reformers include multiple reactor beds within the reformers. This allows for flexibility to control the residence time of the process streams passed to the reformers.

The reforming process is a common process in the refining of petroleum, and is usually used for increasing the amount of gasoline. The reforming process comprises mixing a stream of hydrogen and a hydrocarbon mixture and contacting the resulting stream with a reforming catalyst. The usual feedstock is a naphtha feedstock and generally has an initial boiling point of about 80° C. and an end boiling point of about 205° C. The reforming reactors are operated with a feed inlet temperature between 450° C. and 540° C. The reforming reaction converts paraffins and naphthenes through dehydrogenation and cyclization to aromatics. The dehydrogenation of paraffins can yield olefins, and the dehydrocyclization of paraffins and olefins can yield aromatics.

Reforming catalysts generally comprise a metal on a support. The support can include a porous material, such as an inorganic oxide or a molecular sieve, and a binder with a weight ratio from 1:99 to 99:1. The weight ratio is preferably from about 1:9 to about 9:1. Inorganic oxides used for support include, but are not limited to, alumina, magnesia, titania, zirconia, chromia, zinc oxide, thoria, boria, ceramic, porcelain, bauxite, silica, silica-alumina, silicon carbide, clays, crystalline zeolitic aluminasilicates, and mixtures thereof. Porous materials and binders are known in the art and are not presented in detail here. The metals preferably are one or more Group VIII noble metals, and include platinum, iridium, rhodium, and palladium. Typically, the catalyst contains an amount of the metal from about 0.01% to about 2% by weight, based on the total weight of the catalyst. The catalyst can also include a promoter element from Group IIIA or Group IVA. These metals include gallium, germanium, indium, tin, thallium and lead.

Therefore, increases can be achieved through innovative flow schemes that allow for process control of the reactions.

While the invention has been described with what are presently considered the preferred embodiments, it is to be understood that the invention is not limited to the disclosed embodiments, but it is intended to cover various modifications and equivalent arrangements included within the scope of the appended claims.

The invention claimed is:

1. A process for producing aromatics from a naphtha feedstream comprising:

passing the feedstream to a fractionation unit, thereby generating a first stream comprising light hydrocarbons, a second stream comprising intermediate hydrocarbons, and a third stream comprising heavy hydrocarbons;

passing the first stream to a first reformer, operated at a first set of reaction conditions, thereby generating a first reformer effluent stream;

passing the second stream to a second reformer, operated at a second set of reaction conditions, thereby generating a second reformer effluent stream;

passing the third stream to a third reformer, operated at a third set of reaction conditions, thereby creating a third reformer effluent stream;

passing the first reformer effluent stream and the second reformer effluent stream to a fourth reformer, operated at a fourth set of reaction conditions, thereby generating a fourth reformer effluent stream;

passing the third reformer effluent stream and the fourth reformer effluent stream to a fifth reformer, operated at a fifth set of reaction conditions, thereby generating a fifth reformer effluent stream;

passing the fifth reformer effluent stream to an aromatics extraction unit, thereby creating a purified aromatics stream and a raffinate stream.

2. The process of claim 1 wherein the fifth reformer can comprise a plurality of reformers with interbed heaters.

3. The process of claim 1 wherein the first stream comprises C6 and lighter hydrocarbons.

4. The process of claim 1 wherein the second stream comprises C7 hydrocarbons.

5. The process of claim 1 wherein the third stream comprises C8 and heavier hydrocarbons.

6. The process of claim 1 further comprising:

passing the fifth reformer effluent stream to a light hydrocarbon fractionation unit, thereby creating a light hydrocarbon stream and a light hydrocarbon process stream;

passing the light hydrocarbon process stream to a reformate splitter, thereby creating a reformate overhead comprising lighter aromatics and a reformate bottoms stream comprising heavier aromatics; and passing the reformate overhead to the aromatics extraction unit.

7. The process of claim 6 wherein the reformate overhead comprises lighter aromatics in the C6 and C7 range.

8. The process of claim 6 wherein the reformate bottoms stream comprises heavier aromatics in the C8+ range.

9. The process of claim 1 further comprising:

wherein each reformer has a catalyst inlet and a catalyst outlet;

passing a first catalyst stream, comprising fresh catalyst, to the first reformer, thereby generating a first reformer catalyst effluent stream having catalyst with partial coking;

passing the first reformer catalyst effluent stream to the fourth reformer, thereby generating a fourth reformer catalyst effluent stream;

passing the fourth reformer catalyst effluent stream to the fifth reformer, thereby generating a fifth reformer catalyst effluent stream;

passing a second catalyst stream, comprising fresh catalyst, to the second reformer, thereby generating a second reformer catalyst effluent stream having catalyst with partial coking;

passing the second reformer catalyst effluent stream to the third reformer, thereby generating a third reformer catalyst effluent stream; and passing the third reformer catalyst effluent stream and the fifth reformer catalyst effluent stream to a regenerator.

10. The process of claim 9 further comprising:

passing the first stream to a sixth reformer, operated at a sixth set of reaction conditions, thereby generating a sixth reformer effluent stream, prior to passing the first stream to the first reformer, and passing the sixth reformer effluent stream to the first reformer;

passing the second catalyst effluent stream to the sixth reformer, prior to passing the second catalyst effluent stream to the second reformer, thereby generating a sixth reformer catalyst effluent stream; and passing the sixth reformer catalyst effluent stream to the second reformer.

11. The process of claim 1 further comprising:

wherein each reformer has a catalyst inlet and a catalyst outlet;

passing a first catalyst stream, comprising fresh catalyst, to the first reformer, thereby generating a first reformer catalyst effluent stream having catalyst with partial coking;

passing the first reformer catalyst effluent stream to the fourth reformer, thereby generating a fourth reformer catalyst effluent stream;

passing the fourth reformer catalyst effluent stream to the second reformer, thereby generating a second reformer catalyst effluent stream;

passing a second catalyst stream, comprising fresh catalyst, to the third reformer, thereby generating a third reformer catalyst effluent stream having catalyst with partial coking;

passing the third reformer catalyst effluent stream to the fifth reformer, thereby generating a fifth reformer catalyst effluent stream; and passing the second reformer catalyst effluent stream and the fifth reformer catalyst effluent stream to a regenerator.

12. The process of claim 11 further comprising:

passing the first stream to a sixth reformer, operated at a sixth set of reaction conditions, thereby generating a sixth reformer effluent stream, prior to passing the first stream to the first reformer, and passing the sixth reformer effluent stream to the first reformer;

passing the fourth catalyst effluent stream to the sixth reformer, prior to passing the fourth catalyst effluent stream to the second reformer, thereby generating a sixth reformer catalyst effluent stream; and passing the sixth reformer catalyst effluent stream to the second reformer.

13. The process of claim 1 further comprising:

wherein each reformer has a catalyst inlet and a catalyst outlet;

passing a first catalyst stream, comprising fresh catalyst, to the first reformer, thereby generating a first reformer catalyst effluent stream having catalyst with partial coking;

passing the first reformer catalyst effluent stream to the fourth reformer, thereby generating a fourth reformer catalyst effluent stream;

passing the fourth reformer catalyst effluent stream to the third reformer, thereby generating a third reformer catalyst effluent stream;

passing a second catalyst stream, comprising fresh catalyst, to the second reformer, thereby generating a second reformer catalyst effluent stream having catalyst with partial coking;

passing the second reformer catalyst effluent stream to the fifth reformer, thereby generating a fifth reformer catalyst effluent stream; and passing the third reformer catalyst effluent stream and the fifth reformer catalyst effluent stream to a regenerator.

14. The process of claim 13 further comprising:

passing the first stream to a sixth reformer, operated at a sixth set of reaction conditions, thereby generating a sixth reformer effluent stream, prior to passing the first stream to the first reformer, and passing the sixth reformer effluent stream to the first reformer;

passing the fourth catalyst effluent stream to the sixth reformer, prior to passing the fourth catalyst effluent stream to the third reformer, thereby generating a sixth reformer catalyst effluent stream; and passing the sixth reformer catalyst effluent stream to the third reformer.

15. A process for producing aromatics from a naphtha feedstream comprising:

passing the feedstream to a fractionation unit, thereby generating a first stream comprising light hydrocarbons, a second stream comprising heavy hydrocarbons, and a third stream comprising intermediate hydrocarbons;

passing the first stream to a first reformer, operated at a first set of reaction conditions, thereby generating a first reformer effluent stream;

passing the second stream to a second reformer, operated at a second set of reaction conditions, thereby generating a second reformer effluent stream;

passing the third stream to a third reformer, operated at a third set of reaction conditions, thereby creating a third reformer effluent stream;

passing the first reformer effluent stream and the second reformer effluent stream to a fourth reformer, operated at a fourth set of reaction conditions, thereby generating a fourth reformer effluent stream;

passing the fourth reformer effluent stream to a fifth reformer, operated at a fifth set of reaction conditions, thereby generating a fifth reformer effluent stream;

passing the fifth reformer effluent stream to an aromatics extraction unit; and passing the third reformer effluent stream to the aromatics extraction unit, thereby creating a purified aromatics stream and a raffinate stream.

16. The process of claim 15 further comprising:

passing a first catalyst stream to the first reformer, thereby generating a first reformer catalyst effluent stream;

passing the first reformer catalyst effluent stream to the fourth reformer, thereby generating a fourth reformer catalyst effluent stream;

passing the fourth reformer catalyst effluent stream to the fifth reformer, thereby generating a fifth reformer catalyst effluent stream; and passing the fifth reformer catalyst effluent stream to the second reformer, thereby generating a second reformer catalyst effluent stream.

17. The process of claim 16 further comprising:

passing the second reformer catalyst effluent stream to a catalyst regenerator thereby regenerating the catalyst, to generate a regenerated catalyst stream; and passing the regenerated catalyst stream to the first reformer, thereby generating the first catalyst stream.

18. The process of claim 17 further comprising:

passing the first stream to a sixth reformer prior to passing the first stream to the first reformer, thereby generating a sixth reformer effluent stream;

passing the sixth reformer effluent stream to the first reformer;

passing the second reformer catalyst effluent stream to the sixth reformer, thereby generating a sixth catalyst effluent stream; and passing the sixth catalyst effluent stream to the catalyst regenerator, to generate the first catalyst stream.

19. The process of claim 15 further comprising:

prior to passing the third reformer effluent stream to the aromatics extraction unit, passing the to a seventh reformer effluent stream;

passing a second catalyst stream to the seventh reformer, thereby generating a seventh reformer catalyst effluent stream;

passing the seventh reformer catalyst effluent stream to the third reformer, thereby generating a third reformer catalyst effluent stream; and passing the third reformer catalyst effluent stream to a regenerator to generate the second catalyst stream.

20. The process of claim 19 wherein the first catalyst stream and the second catalyst stream comprise different catalysts.

* * * * *